US011737584B2

(12) United States Patent
McAndrew

(10) Patent No.: US 11,737,584 B2
(45) Date of Patent: Aug. 29, 2023

(54) AIR CURTAIN GUIDES FOR REFRIGERATORS

(71) Applicant: Aerofoil Energy Limited, Cheshire (GB)

(72) Inventor: Paul McAndrew, Cheshire (GB)

(73) Assignee: Aerofoil Energy Limited, Cheshire (GB)

( * ) Notice: Subject to any disclaimer, the term of this patent is extended or adjusted under 35 U.S.C. 154(b) by 0 days.

(21) Appl. No.: 17/522,514

(22) Filed: Nov. 9, 2021

(65) Prior Publication Data

US 2022/0175155 A1 Jun. 9, 2022

Related U.S. Application Data

(63) Continuation of application No. PCT/GB2020/051131, filed on May 7, 2020.

(30) Foreign Application Priority Data

May 10, 2019 (GB) ..... 1906654

(51) Int. Cl.
*A47F 3/04* (2006.01)
*F25D 23/02* (2006.01)
*F24F 9/00* (2006.01)

(52) U.S. Cl.
CPC ..... *A47F 3/0447* (2013.01); *F25D 23/023* (2013.01); *F24F 9/00* (2013.01)

(58) Field of Classification Search
CPC ..... A47F 3/0447; A47F 3/06; A47F 3/0491; F25D 23/023; F24F 9/00
See application file for complete search history.

(56) References Cited

U.S. PATENT DOCUMENTS

| | | | | |
|---|---|---|---|---|
| 2,387,622 | A | 10/1945 | Tanner | |
| 2,822,672 | A | 2/1958 | Dickson | |
| 3,063,252 | A | 11/1962 | Lamb | |
| 3,063,253 | A | 11/1962 | Dickson et al. | |
| 3,084,463 | A | 4/1963 | Reynolds et al. | |
| 3,747,726 | A | 7/1973 | Walter | |
| 4,221,443 | A * | 9/1980 | Heaney | F25D 25/02 312/111 |
| 8,729,429 | B2 | 5/2014 | Nuttall et al. | |
| 9,370,262 | B2 | 6/2016 | Wirth | |

(Continued)

FOREIGN PATENT DOCUMENTS

| | | | |
|---|---|---|---|
| CN | 101014268 | A | 8/2007 |
| CN | 101031225 | A | 9/2007 |

(Continued)

OTHER PUBLICATIONS

Translation GB-2560932-A (Year: 2018).*

(Continued)

*Primary Examiner* — David J Teitelbaum
(74) *Attorney, Agent, or Firm* — Cooley LLP

(57) ABSTRACT

An air curtain guide mounting kit for attaching an air curtain guide to an open-display refrigerator, the kit comprising: an arm adapted to be mounted to the refrigerator; and a bracket comprising an engagement section adapted to be connected to an air curtain guide, and a mounting section connected to the engagement section and adapted to form a hinged connection with the arm.

19 Claims, 9 Drawing Sheets

(56) References Cited

U.S. PATENT DOCUMENTS

| | | | | |
|---|---|---|---|---|
| D777,225 | S | 1/2017 | McAndrew | |
| D824,963 | S | 8/2018 | McAndrew | |
| D854,590 | S | 7/2019 | McAndrew | |
| 2005/0217297 | A1 | 10/2005 | Wilson | |
| 2006/0059934 | A1* | 3/2006 | Howington | A47B 57/045 62/251 |
| 2007/0251253 | A1 | 11/2007 | Alahyari et al. | |
| 2008/0205040 | A1 | 8/2008 | Shibusawa et al. | |
| 2008/0236182 | A1* | 10/2008 | Hahn | A47F 3/0447 62/251 |
| 2012/0092350 | A1 | 4/2012 | Ganapathi et al. | |
| 2013/0112634 | A1* | 5/2013 | Nagel | A47F 1/128 211/59.3 |
| 2016/0302591 | A1 | 10/2016 | McAndrew | |
| 2018/0325284 | A1 | 11/2018 | McAndrew et al. | |
| 2019/0142186 | A1* | 5/2019 | Wirth | A47F 3/0486 454/191 |
| 2019/0195552 | A1 | 6/2019 | Roesch et al. | |
| 2019/0274452 | A1 | 9/2019 | McAndrew | |
| 2019/0360738 | A1 | 11/2019 | McAndrew | |
| 2021/0393052 | A1 | 12/2021 | McAndrew et al. | |
| 2022/0232999 | A1 | 7/2022 | McAndrew | |

FOREIGN PATENT DOCUMENTS

| | | | | | |
|---|---|---|---|---|---|
| EP | 0441357 | A2 | | 8/1991 | |
| EP | 0722158 | B1 | | 4/1999 | |
| FR | 2690825 | A1 | | 11/1993 | |
| FR | 2764787 | A1 | | 12/1998 | |
| GB | 0249295 | A | | 3/1926 | |
| GB | 2527636 | A | | 12/2015 | |
| GB | 2541996 | A | | 3/2017 | |
| GB | 2560932 | A | * | 10/2018 | A47F 3/04 |
| GB | 2563407 | A | * | 12/2018 | A47B 96/02 |
| GB | 2571116 | A | | 8/2019 | |
| JP | S5072330 | A | | 6/1975 | |
| JP | S51150569 | U | | 12/1976 | |
| JP | S5374768 | U | | 6/1978 | |
| JP | S55165468 | A | | 12/1980 | |
| JP | S57152073 | U | | 9/1982 | |
| JP | S58110977 | A | | 7/1983 | |
| JP | S59174588 | U | | 11/1984 | |
| JP | S62162569 | U | | 10/1987 | |
| JP | 2004278865 | A | | 10/2004 | |
| JP | 2010207564 | A | | 9/2010 | |
| JP | 2010207565 | A | | 9/2010 | |
| JP | 2010207565 | A | | 9/2010 | |
| JP | 2011131036 | A | | 7/2011 | |
| JP | 2011167384 | A | | 9/2011 | |
| JP | 2014198069 | A | | 10/2014 | |
| KR | 19990013134 | U | * | 4/1999 | F25D 25/02 |
| KR | 10-2011-0092935 | A | | 8/2011 | |
| KR | 20120008561 | A | * | 2/2012 | A47F 5/101 |
| WO | WO 2005023060 | A1 | | 3/2005 | |
| WO | WO 2008052721 | A1 | | 5/2008 | |
| WO | WO-2012112115 | A1 | | 8/2012 | |
| WO | WO-2014167320 | A1 | | 10/2014 | |
| WO | WO-2018200997 | A1 | | 11/2018 | |
| WO | WO 2019/227119 | A1 | | 12/2019 | |
| WO | WO 2021/005335 | A1 | | 1/2021 | |

OTHER PUBLICATIONS

Translation GB-2563407-A (Year: 2018).*
Translation KR-20120008561-A (Year: 2012).*
Translation KR-19990013134-U (Year: 1999).*
Written Opinion for International Application No. PCT/GB2020/051131 dated Aug. 20, 2020, 6 pages.
Search Report, dated Nov. 8, 2019, for United Kingdom Application No. GB1906654.7 (5 pages).
Examination Report, dated Oct. 27, 2022, for United Kingdom Application No. GB1906654.7 (1 total page).
International Search Report and Written Opinion, dated Aug. 20, 2020, for International Application No. PCT/GB2020/051131 (9 total pages).
International Preliminary Report on Patentability, dated Nov. 25, 2021, for PCT International Application No. PCT/GB2020/051131 (8 total pages).
Examination Report, dated Apr. 20, 2023, for UK Patent Application No. GB1906654.7 (5 pages).

* cited by examiner

AIR CURTAIN GUIDES FOR REFRIGERATORS

CROSS REFERENCE TO RELATED APPLICATIONS

This application is a continuation of International Patent Application No. PCT/GB2020/051131, entitled "Improvements To Refrigerators" and filed on May 7, 2020, the entire contents of which are hereby incorporated by reference. International Patent Application No. PCT/GB2020/051131 claims priority to G.B. Application No. 1906654.7, entitled "Improvements To Refrigerators" and filed on May 10, 2019.

TECHNICAL FIELD

The invention relates to an air curtain guide mounting kit for attaching an air curtain guide to a refrigerator, in particular a refrigerator which comprises product-pushers.

BACKGROUND

Open display refrigerators are commonly used in retail environments, such as supermarkets, to store and display products which must be kept at lower than ambient temperatures. The open front of such a refrigerator makes it easy for customers to view the products being displayed and to retrieve products they wish to purchase from the refrigerator.

This type of refrigerator has an air curtain, which is established by blowing cold air across the front of the refrigerator. The air curtain issues from an air outlet at the top of the refrigerator towards an air inlet at the bottom of the refrigerator. The air inlet recovers air from the air curtain and recirculates it to the air outlet via a cooling heat exchanger and fan. The air curtain prevents cold air in the refrigerator from mixing with warm air exterior to the refrigerator.

However, upon its passage from the air outlet at the top of the refrigerator towards the air inlet at the bottom of the refrigerator, the cold air of the air curtain mixes with the warm ambient air adjacent to it as it travels down across the open front of the refrigerator. Such mixing is known as "infiltration". Turbulence increases mixing of the warm ambient air with the cold air of the air curtain, and leads to additional warm air passing through the air curtain into the interior of the fridge. Increased infiltration leads to more energy being used by the refrigerator as it strives to maintain the desired temperature in its interior storage space.

In order to reduce turbulence and thus infiltration, open display refrigerators may be provided with one or more air curtain guides for guiding flow of air within the air curtain (i.e. guiding air which is moving out of a stream of the air curtain back into the stream of the air curtain). Air curtain guides may also include a housing for displaying product information labels, in order that the customer can be provided with product and pricing information.

Some open display refrigerators have "product pushers" (also known as "stock pushers" or "shelf pushers") instead of shelves. Product pushers keep the displayed products towards the front of the refrigerator product display space, by advancing the remaining products forward (i.e. toward the customer) following removal of the front-most product from the display. This type of system may be used for items such as, for example, pre-prepared bagged salads.

Product pushers typically comprise a product-receiving section and a product pushing section, and may be provided as cassettes (a plurality of which can then be placed adjacent to one another to form an array). These cassettes may be mounted in the refrigerator in such a manner that they can slide forward for easy re-filling by store staff. The filled product pusher cassette can then be slid back into place in the product display space of the refrigerator, ready for selection of products by the customer.

Installation of air curtain guides in open-display refrigerators containing product pushers presents a number of challenges. Firstly, air curtain guides are typically fixed to a customer-facing edge of a shelf of the refrigerator. However, product pusher-containing refrigerators typically have product pushers instead of shelves, hence there is no customer-facing shelf edge to which an air curtain guide can be fixed. Secondly, the sliding action of product pusher cassettes (as described above) means that they would collide with the air curtain guide when store staff attempt to slide them out of the product display space for re-stocking.

It would therefore be desirable to provide a means of fixing an air curtain guide to a product pusher-containing refrigerator. It would also be desirable to provide a means of fixing an air curtain guide to such a refrigerator which allows for the product pusher cassettes to be slid out from the display space of the refrigerator for re-stocking.

SUMMARY

In accordance with a first aspect of the invention, there is provided an air curtain guide mounting kit for attaching an air curtain guide to an open-display refrigerator, the kit comprising: an arm adapted to be mounted to the refrigerator; and a bracket comprising an engagement section adapted to be connected to an air curtain guide, and a mounting section connected to the engagement section and adapted to form a hinged connection with the arm.

In one embodiment, the engagement section is adapted to grip the air curtain guide such that the air curtain guide is held captive by the engagement section.

In one such embodiment, the engagement section is adapted to receive the air curtain guide by way of a snap-fit action.

In one such embodiment, the engagement section comprises a first recess for mating with a first edge of the air curtain guide, and a second recess for mating with a second edge of the air curtain guide, the first and second edges of the air curtain guide being opposing edges.

In another embodiment, the engagement section is adapted to be connected to the air curtain guide by way of a mechanical fastener.

In one such embodiment, the engagement section comprises a recess for receiving the mechanical fastener.

In some embodiments, the mechanical fastener is a screw or a bolt.

In some embodiments, the engagement section is integral with the mounting section.

In some embodiments, the bracket is adapted to form a hinged connection to the arm by way of a snap-fit action.

In some embodiments, the bracket comprises at least one first protrusion which is adapted to engage with at least one corresponding first recess in the arm so as to form the hinged connection. In some embodiments, the at least one first protrusion is rotatable within the at least one first recess. The bracket may comprise a pair of said first protrusions and the arm comprises a pair of said first recesses.

In other embodiments, the bracket comprises at least one first protrusion which is adapted to engage with at least one corresponding first through-hole in the arm so as to form the hinged connection. In some embodiment, the at least one first protrusion is rotatable within the at least one first through-hole. The bracket may comprise a pair of said first protrusions and the arm comprises a pair of said first though-holes.

In some embodiments, the bracket is made of a plastic material. For example, the plastic material may be nylon, glass-injected nylon, polyethylene, polyvinyl chloride, polypropylene, acrylic, polycarbonate, polyethylene, polyethylene terephthalate, or polyethylene terephthalate glycol-modified.

In some embodiments, the arm is made of a metal or a metal alloy. For example, the metal or metal alloy may be aluminium, iron, steel or stainless steel.

In some embodiments, the air curtain guide mounting further comprises a locking mechanism, wherein the locking mechanism has a first state in which the bracket and arm are prevented from moving relative to one another, and a second state in which the bracket and arm are movable relative to one another.

In some embodiments, the locking mechanism comprises a second protrusion on the bracket and a second through-hole in the arm, the second protrusion adapted to releasably engage with the second through-hole.

In other embodiments, the locking mechanism comprises a second protrusion on the bracket and a second recess in the arm, the second protrusion adapted to releasably engage with the second recess.

In some embodiments, the locking mechanism further comprises a button connected to the second protrusion such that depression of the button disengages the second protrusion from the second through-hole or second recess.

In some embodiments, the arm is adapted to be mounted to a rear wall of a product display space of the refrigerator.

In another aspect, the present invention comprises an open-display refrigerator comprising an air curtain guide mounting kit according to any of the embodiments described above mounted thereto, and an air curtain guide connected to the engagement section of the air curtain guide mounting kit.

In some embodiments, the refrigerator comprises a product pusher cassette located in a product display space of the refrigerator. In some embodiments, the product pusher cassette comprises a product-receiving section and a product-pushing section. The product-pushing section may be spring-loaded.

In some embodiments, the product pusher cassette is slidably mounted in the product display space of the refrigerator.

In some embodiments, the arm is positioned adjacent to an underside of the product pusher cassette.

In some embodiments, the refrigerator comprises a plurality of said product pusher cassettes positioned next to one another so as to form an array of product pusher cassettes extending across at least a portion of a lateral width of the product display space. In some embodiments, the array has at least one air curtain guide mounting kit associated with it, the arm of the at least one air curtain guide mounting kit being positioned adjacent to an underside of the array. In some embodiments, the refrigerator comprises a plurality of said arrays.

In any of the above embodiments of the air curtain guide mounting kit or the open display refrigerator, the air curtain guide is an aerofoil.

BRIEF DESCRIPTION OF THE DRAWINGS

An exemplary embodiment of the invention will now be described with reference to the accompanying drawings, in which.

DETAILED DESCRIPTION

Figure 1:
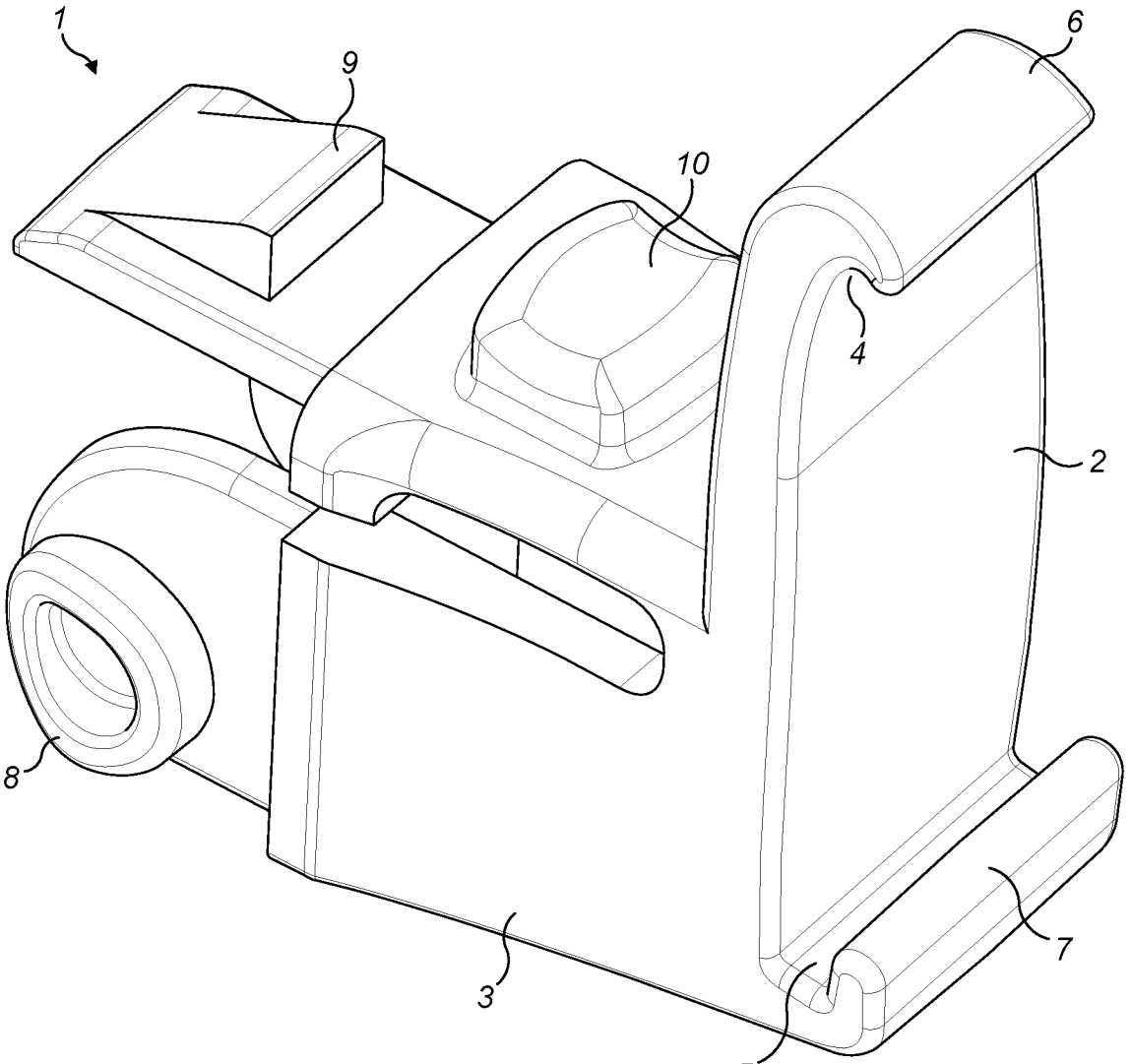
FIG. 1 is a perspective view of a bracket of an air curtain guide mounting kit according to an exemplary embodiment of the invention.
Figure 2:
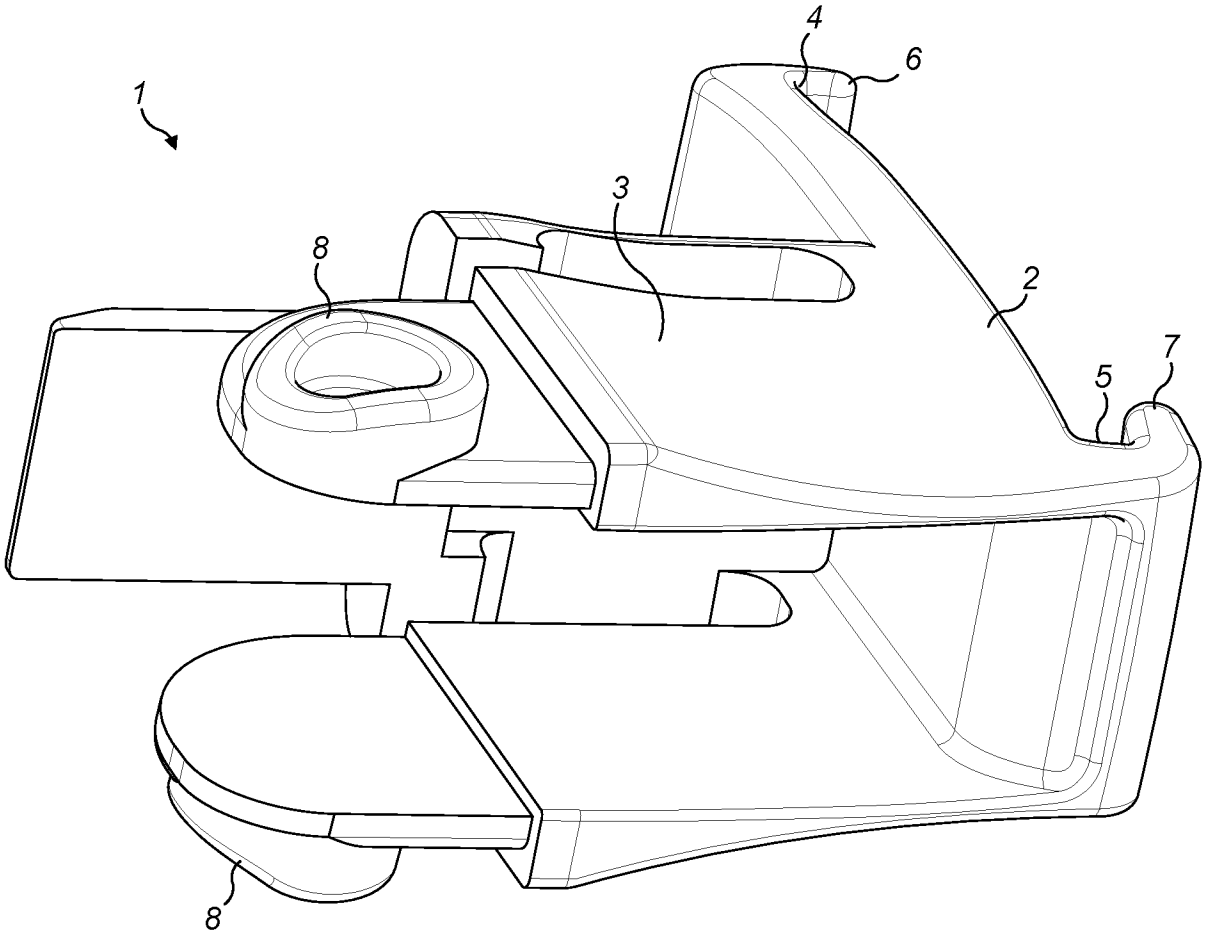
FIG. 2 is an alternative perspective view of the bracket of FIG. 1.
Figure 3:
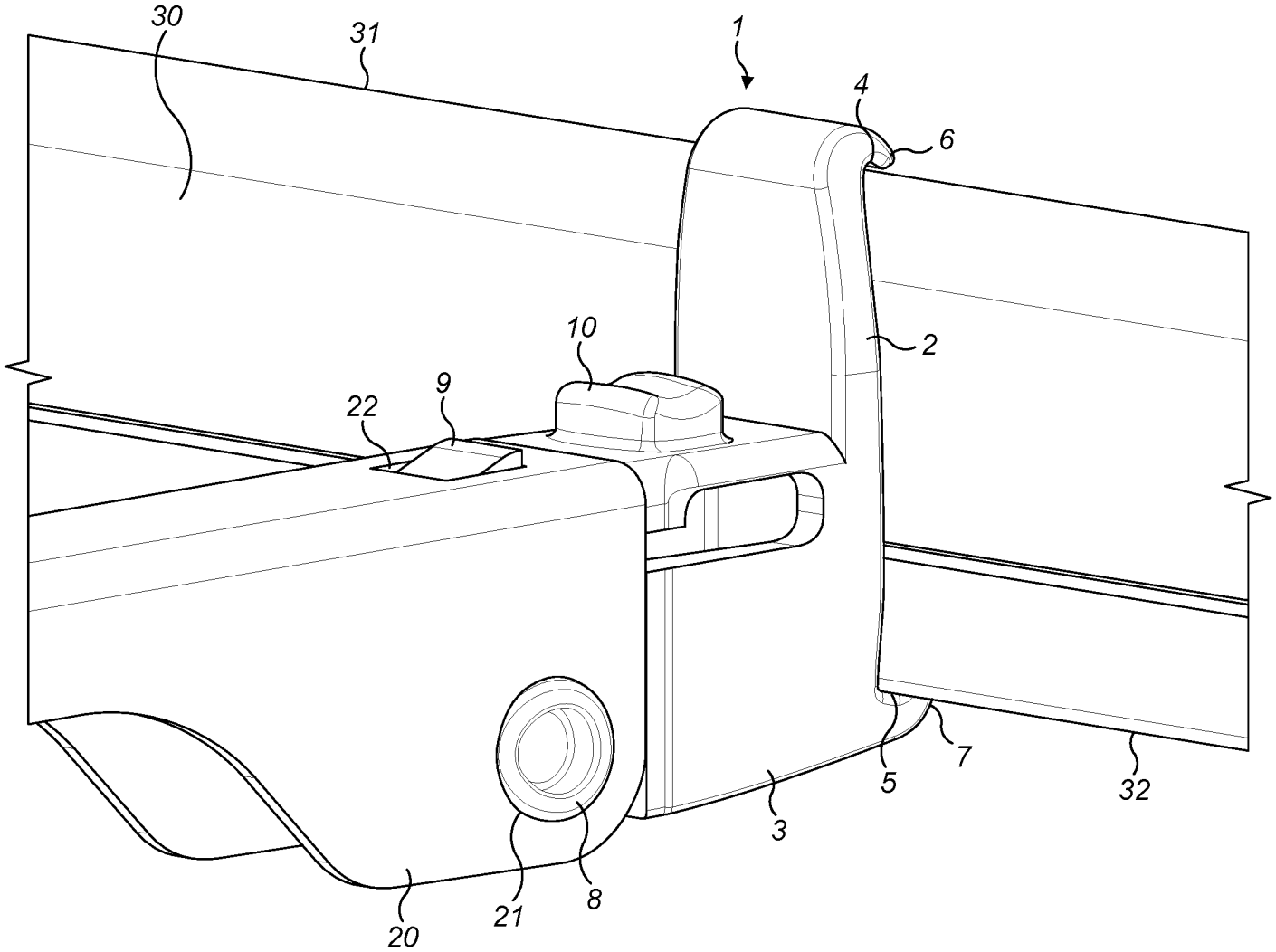
FIG. 3 is a perspective view of the bracket connected to an arm of the air curtain guide mounting kit, and also shows an air curtain guide.
Figure 4:
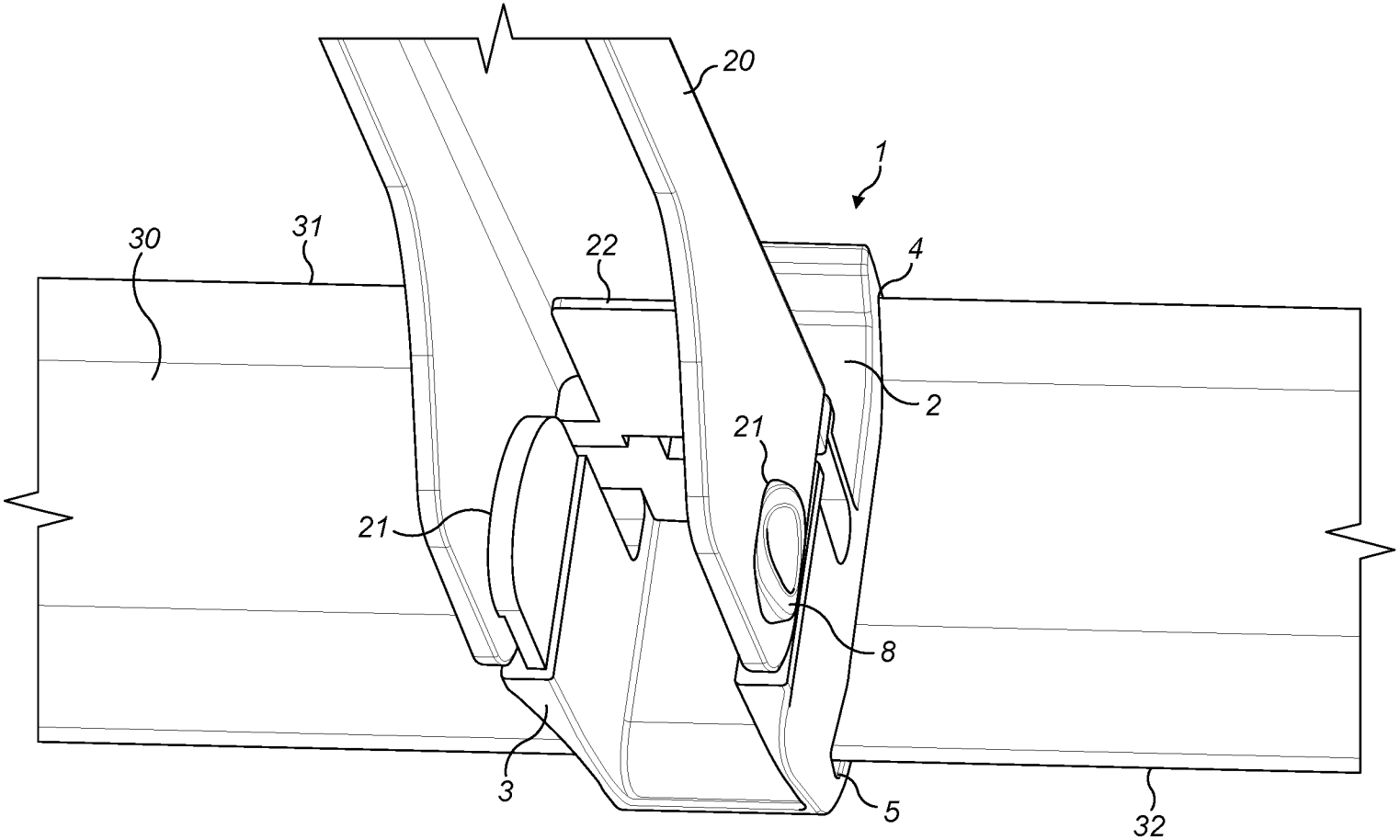
FIG. 4 shows an alternative perspective view of the bracket, arm and air curtain guide of FIG. 3.

FIGS. 1 and 2 show perspective views of a bracket 1 of an air curtain guide mounting kit according to an exemplary embodiment of the invention. FIGS. 3 and 4 show perspective views of the bracket 1 connected to an arm 20 of the air curtain guide mounting kit (an air curtain guide 30 is also shown).

As shown in FIGS. 1 and 2, the bracket 1 comprises an engagement section 2 which is integral with a mounting section 3. The engagement section 2 is adapted to receive the air curtain guide (not shown in FIGS. 1 and 2) by way of a snap-fit action, and to grip the air curtain guide such that it is held captive by the engagement section 2. The engagement section 2 comprises a first recess 4 for mating with a first edge of the air curtain guide, and a second recess 5 for mating with a second edge of the air curtain guide, the first and second edges of the air curtain guide being opposing edges. The first recess 4 is defined by a first distal protruding portion 6 of the engagement section 2, and the second recess 5 of the engagement section 2 is defined by a second distal protruding portion 7 of the engagement section 2.

The mounting section 3 comprises a pair of first protrusions 8 which are adapted to engage with a corresponding pair of first through-holes 21 in the arm 20 (as shown in FIGS. 3 and 4). The first protrusions 8 and the first through-holes 21 form a hinge about which the bracket 1 may move relative to the arm 20, by rotation of the first protrusions 8 in the first through-holes 21. In an alternative embodiment (not shown), the pair of first through-holes 21 could be replaced by a pair of first recesses in the arm 20, the pair of first protrusions 8 of the bracket being adapted to engage with the pair of first recesses so as to form the hinge.

In one embodiment, the arm 20 is made of a metal or metal alloy, and the bracket 1 is made of a plastic material. This provides the advantage of avoidance of snagging or scraping, which could occur if both the bracket 1 and the arm 20 were made of a metal or metal alloy. The bracket 1 can flex so as to allow insertion of the pair of first protrusions 8 into the pair of through-holes 21 of the arm 20, thus making the air curtain guide mounting kit easy to assemble as no additional fixings are required in order to connect the bracket 1 to the arm 20.

FIGS. 3 and 4 show the air curtain guide mounting kit of FIG. 1 in which an air curtain guide 30 is inserted into the engagement section 2 of the bracket 1. In this embodiment, the air curtain guide 30 is an aerofoil. The air curtain guide 30 may be inserted into the engagement section 2 by inserting a second edge 32 of the air curtain guide 30 into the second recess 5 of the engagement section 2, and then pushing the first edge 31 of the air curtain guide 30 past the first distal protruding portion 6 and into the first recess 4 of the engagement section 2, in order to "snap" the air curtain guide 30 into a position where it is gripped between the first and second recesses 4,5 of the engagement section 2. The engagement section 2 can grip the air curtain guide 30 anywhere along its length, thus allowing the arm 20 (to which the bracket 1 is attached) to be fixed to the refrigerator at any point along the lateral width of the product display space. In an alternative embodiment (not shown), the air curtain guide comprises a through-hole through which a mechanical fastener (e.g. a screw or a bolt) can be inserted, and the engagement section comprises a recess for receiving the mechanical fastener, thus connecting the air curtain guide to the engagement section.

Figure 5:
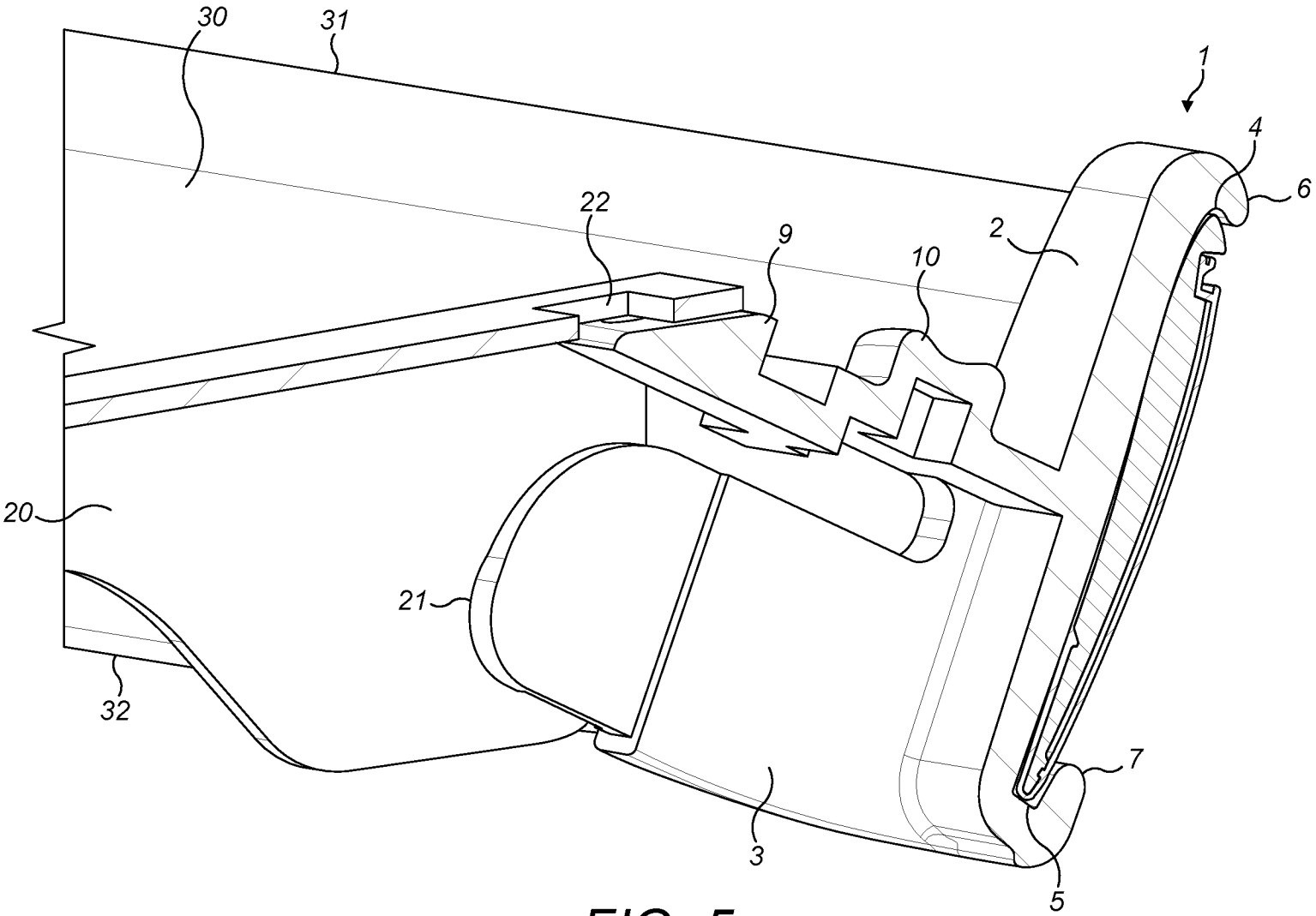
FIG. 5 is a cutaway view of the bracket, arm and air curtain guide of FIG. 3, showing disengagement of the second protrusion from the second through-hole.

The bracket 1 also comprises a second protrusion 9 which is adapted to releasably engage with a second through-hole 22 in the arm 20. When the second protrusion 9 is engaged with the second through-hole 22, the bracket 1 is prevented from moving relative to the arm 20 about the hinge (as shown in FIG. 3). When the second protrusion 9 is disengaged from the second through-hole 22 (by the action of pushing a button 10 which is connected to the second protrusion 9 so as to move the second protrusion 9 out of the second through-hole 22), the bracket 1 is then free to move relative to the arm 20 about the hinge (as shown in FIG. 5). In an alternative embodiment (not shown), the second through-hole 22 could be replaced by a second recess in the arm 20, the second protrusion 9 of the bracket 1 being adapted to releasably engage with the second recess.

Figure 6:
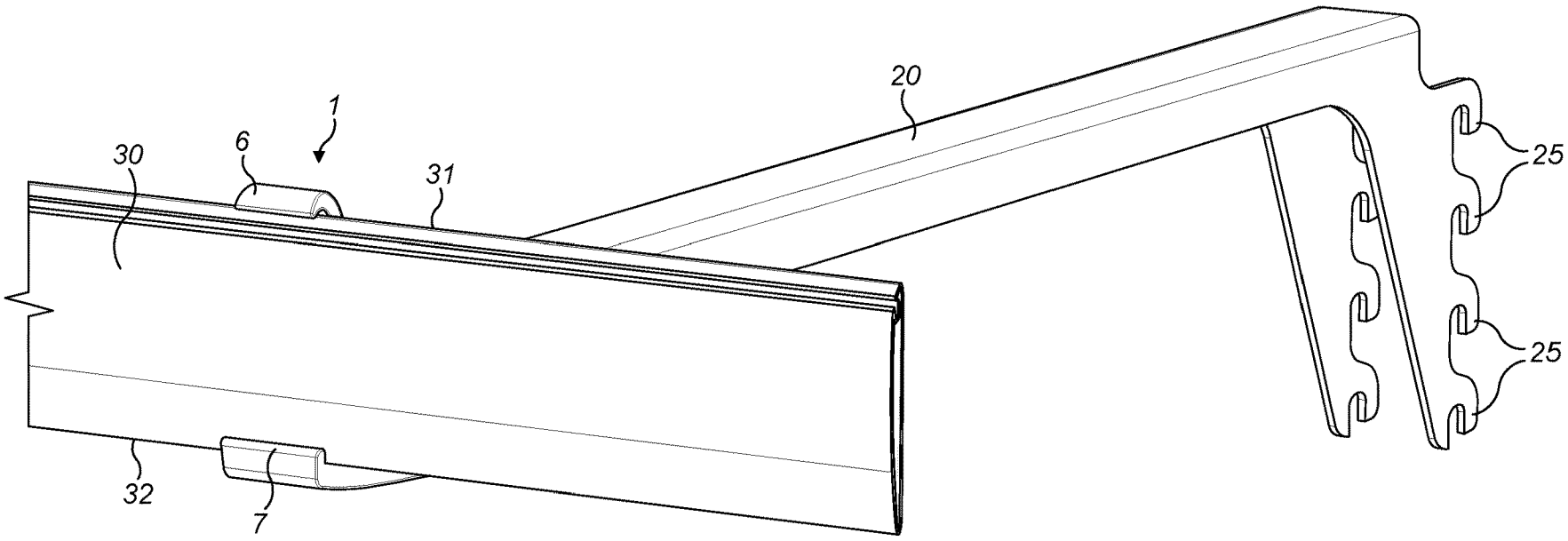
FIG. 6 shows an example of how the arm may be adapted for mounting to a refrigerator.
Figure 7:
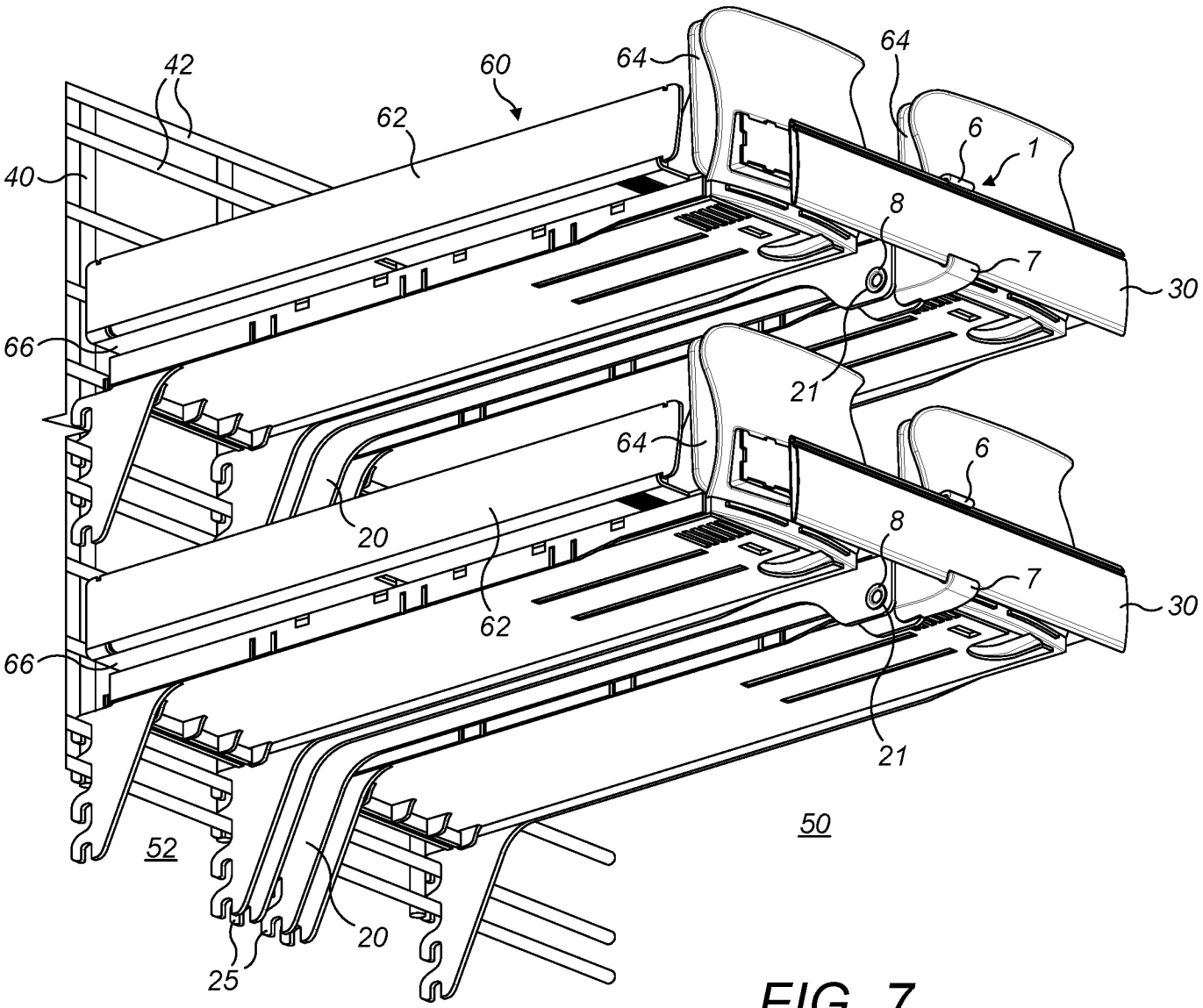
FIG. 7 is a perspective view of the bracket and arm of the air curtain guide mounting kit of FIG. 6, installed in a refrigerator which comprises product pusher cassettes.

FIG. 6 illustrates how the arm 20 may be adapted for mounting to an open-display refrigerator. Specifically, FIG. 6 shows adaptation of the arm 20 for mounting to a rear wall of a product display space of an open-display refrigerator. The rear wall of the product display space is the interior wall which is furthest from the open front of the refrigerator. As shown in FIG. 6, the arm 20 comprises a plurality of hooks 25 which are adapted to engage with a mounting grid on the rear wall of the product display space. FIG. 7 shows how such hooks may engage with such a mounting grid 40. The air curtain guide mounting kit of the present invention therefore provides a means of fixing an air curtain guide to a refrigerator which has product pushers rather than shelves.

Figure 8:
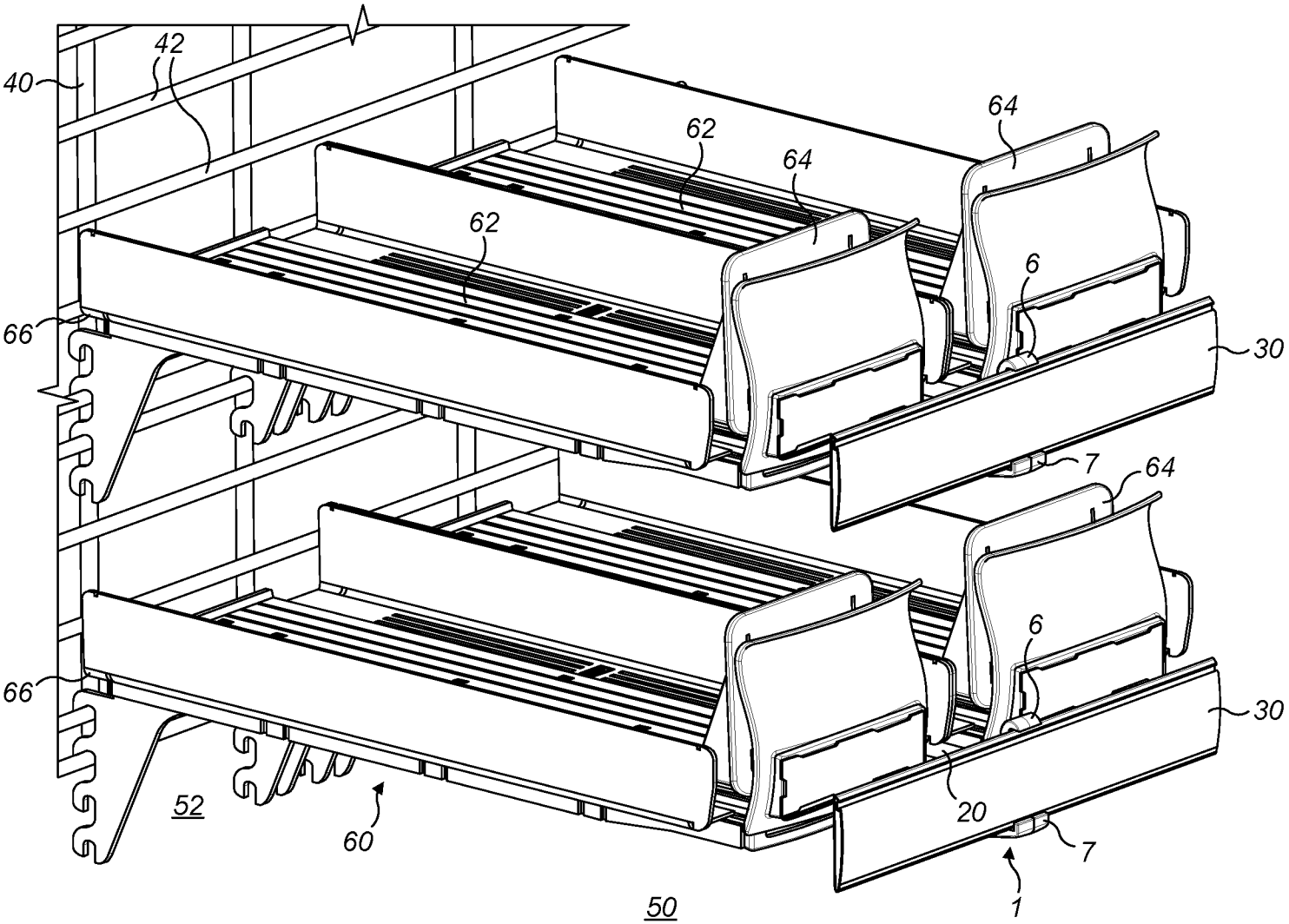
FIG. 8 is an alternative perspective view of FIG. 7.

FIG. 7 shows a product display space 50 of an open-display refrigerator, wherein the product display space 50 has a rear wall 52 which comprises a mounting grid 40. The mounting grid 40 comprises bars 42 to which product pusher cassettes 60 can be mounted. As shown in FIGS. 7 and 8, a plurality of product-pusher cassettes 60 can be mounted adjacent to one another so as to form an array. As shown in FIGS. 7 and 8, the product pusher cassettes 60 include a product receiving section 62 (the products themselves are not shown) and a product pusher section 64. Upon a customer's removal of the front-most product in the cassette 60, the product-pusher section 64 advances (e.g. by spring-loading) in a direction toward the open front of the refrigerator, pushing the remaining products forward toward the front of the display.

Figure 9:
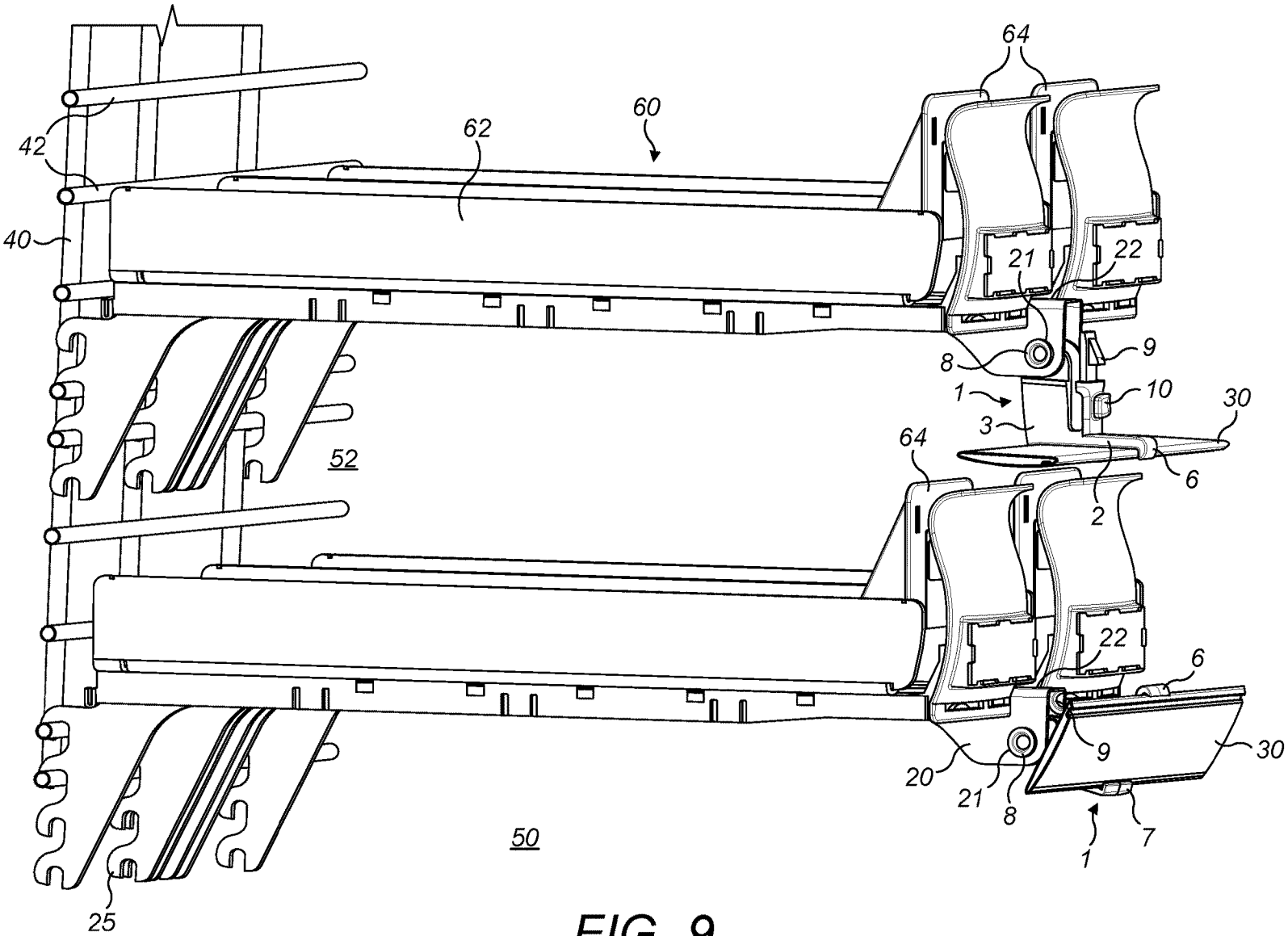
FIG. 9 shows the movement of the bracket relative to the arm upon disengagement of the second protrusion from the second through-hole, and the associated movement of the air curtain guide.

FIGS. 7 and 8 also show the air curtain guide mounting kit of FIG. 6 mounted in the product display space 50 of the refrigerator. Each array of product pusher cassettes has an air curtain guide mounting kit associated with it. Air curtain guides 30 in the form of aerofoils are also shown. As discussed above, the air curtain guide 30 acts to guide flow of air within an air curtain of the open-display refrigerator (i.e. guiding air which is moving out of a stream of the air curtain back into the stream of the air curtain). This increases the efficiency of the refrigerator, as there is less infiltration of warmer ambient air into the air curtain, and also allows lower temperatures to be achieved within the product display space 50. As shown in FIGS. 7 and 8, the air curtain guide 30 is positioned in front of the product pusher cassettes 60. However, when store staff need to re-stock the product-pusher cassettes 60, they can push the button 10 on the bracket 1, thus disengaging the second protrusion 9 of the bracket 1 from the second through-hole 22 of the arm 20, and allowing the bracket 1 to move relative to the arm 20 about the hinge (formed by the first protrusions 8 and the first through-holes 21) so as to move the air curtain guide 30 downwards—as shown in FIG. 9. The air curtain guide 30 is therefore moved out of the path of the product pusher cassettes 60, which can then be slid out of the product display space 50 for easy re-stocking. The air curtain guide mounting kit of the present invention therefore provides a means of fixing an air curtain guide an open-display refrigerator, which allows for the product pusher cassettes 60 to be slid out for re-stocking.

As shown in FIGS. 7 and 8, the air curtain guide mounting kit is positioned such that the arm 20 is adjacent to an underside 66 of the product pusher cassette array with which it is associated. If the arm 20 were to be positioned between two cassettes 60 in the array, then it would occupy space which could otherwise be used for the cassettes 60, hence the space available for display of products would be reduced. By positioning the arm 20 of the air curtain guide mounting kit adjacent to an underside 66 of the array, there is no reduction in the space available for display of products.

The invention claimed is:

1. A kit, comprising:

an arm configured to be coupled to a refrigerator, the arm including at least one of a recess or a through-hole;

a bracket that includes an engagement section configured to be coupled to an air curtain guide, the bracket including a protrusion configured to engage the at least one of the recess or the through-hole to form a hinged connection with the arm;

a locking mechanism configured to transition between a first state in which the protrusion is disposed within the through-hole such that the bracket and arm are prevented from moving relative to one another and a second state in which the bracket and arm are movable relative to one another; and a button connected to the protrusion such that actuation of the button disengages the protrusion from the at least one of the recess or the through-hole to place the locking mechanism in the second state.

2. The kit of claim 1, wherein the engagement section of the bracket is configured to receive the air curtain guide by way of a snap-fit action.

3. The kit of claim 1, wherein the engagement section of the bracket includes a first recess configured to mate with a first edge of the air curtain guide and a second recess configured to mate with a second edge of the air curtain guide opposite the first edge of the air curtain guide.

4. The kit of claim 1, wherein the engagement section of the bracket is configured to be coupled to the air curtain guide by way of a mechanical fastener.

5. The kit of claim 4, wherein the engagement section of the bracket includes a recess configured to receive the mechanical fastener.

6. The kit of claim 1, wherein:

the protrusion is formed on a mounting portion of the bracket; and the bracket, including the engagement section and the mounting portion, is monolithically formed.

7. The kit of claim 1, wherein the bracket is configured to form a hinged connection to the arm by way of a snap-fit action.

8. The kit of claim 1, wherein the protrusion is rotatable within the at least one of the recess or the through-hole.

9. The kit of claim 1, wherein:

the protrusion is a first protrusion;

the at least one of the recess or the through-hole is at least one of a first recess or a first through-hole;

the arm includes at least one of a second recess or a second through-hole; and the bracket includes a second protrusion configured to engage the at least one of the second recess or the second through-hole.

10. The kit of claim 1, wherein the bracket is constructed of at least one of: nylon, glass-injected nylon, polyethylene, polyvinyl chloride, polypropylene, acrylic, polycarbonate, polyethylene, polyethylene terephthalate, or polyethylene terephthalate glycol-modified.

11. The kit of claim 1, wherein the arm is made of a metal or a metal alloy.

12. The kit of claim 1, wherein the bracket is constructed of at least one of aluminium, iron, steel, or stainless steel.

13. A kit, comprising:

an arm configured to be coupled to a refrigerator;

a bracket configured to form a hinged connection with the arm to couple the air curtain guide to the arm;

a locking mechanism configured to transition between a first state in which the bracket and arm are prevented from moving relative to one another and a second state in which the bracket and arm are movable relative to one another; and a button connected to a protrusion such that actuation of the button disengages the protrusion from a recess in the arm to place the locking mechanism in the second state.

14. The kit of claim 13, wherein:

the recess includes a through-hole; and the protrusion is configured to engage the through-hole to form a hinged connection.

15. An open-display refrigerator, comprising:

an air curtain guide;

an arm coupled to the open-display refrigerator, the arm including at least one of a recess or a through-hole;

a bracket coupling the air curtain guide to the arm, the bracket including a protrusion configured to engage the at least one of the recess or the through-hole to form a hinged connection with the arm locking mechanism configured to transition between a first state in which the protrusion is disposed within the at least one of the recess or the through-hole such that the bracket and arm are prevented from moving relative to one another and a second state in which the bracket and arm are movable relative to one another; and a button connected to the protrusion such that actuation of the button disengages the protrusion from the at least one of the recess or the through-hole to place the locking mechanism in the second state.

16. The open-display refrigerator of claim 15, further comprising a product pusher cassette located in a product display space of the open-display refrigerator.

17. The open-display refrigerator of claim 16, wherein the product pusher cassette includes a product-receiving section and a product-pushing section.

18. The open-display refrigerator of claim 16, wherein the product pusher cassette is slidably mounted in the product display space of the refrigerator.

19. The open-display refrigerator of claim 16, wherein the arm is positioned below the product pusher cassette.

* * * * *